US007753732B2

(12) United States Patent
Kameyama et al.

(10) Patent No.: US 7,753,732 B2
(45) Date of Patent: Jul. 13, 2010

(54) SHIELD CONNECTOR STRUCTURE

(75) Inventors: Isao Kameyama, Susono (JP); Motoo Nojima, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/419,033

(22) Filed: Apr. 6, 2009

(65) Prior Publication Data

US 2009/0253295 A1 Oct. 8, 2009

(30) Foreign Application Priority Data

Apr. 7, 2008 (JP) ..... 2008-098957

(51) Int. Cl.
*H01R 13/648* (2006.01)

(52) U.S. Cl. ..... 439/607.27; 439/939

(58) Field of Classification Search ..... 429/607.27, 429/607.28, 939
See application file for complete search history.

(56) References Cited

U.S. PATENT DOCUMENTS 5,637,014 A * 6/1997 Sukegawa et al. ..... 439/607.4
5,865,646 A * 2/1999 Ortega et al. ..... 439/607.28
6,364,706 B1 * 4/2002 Ando et al. ..... 439/607.37
6,491,530 B2 * 12/2002 Koide et al. ..... 439/92
6,666,719 B1 * 12/2003 Kuroi et al. ..... 439/607.19
D515,509 S * 2/2006 Moriwake et al. ..... D13/147

FOREIGN PATENT DOCUMENTS

JP 2006-310164 A 11/2006

* cited by examiner

*Primary Examiner*—Neil Abrams
(74) *Attorney, Agent, or Firm*—Sughrue Mion, PLLC

(57) ABSTRACT

A shield connector structure 1 includes a pair of connectors 2 and 6 that is capable of being fitted to each other and a conductive connector attachment portion 11. One connector 2 includes a terminal metal part 21, an insulating connector housing 22, and a conductive shield shell 23. The other connector 6 includes a terminal metal part 61, an insulating connector housing 62, and a conductive shield shell 63. The shield shell 23 is provided with a connection portion 49, and the shield shell 63 is provided with a connection portion 83. When the connectors 2 and 6 are fitted to each other so that the shield shells 23 and 63 are shield-connected to each other, each of the connection portions 49 and 83 is connected to the connector attachment portion 11 and the shield shells 23 and 63 are grounded.

15 Claims, 12 Drawing Sheets

40 45 24
80 86 65
65 83 63

SHIELD CONNECTOR STRUCTURE

BACKGROUND OF THE INVENTION

1. Field of the Invention

The present invention relates to a shield connector structure which includes a conductive connector attachment portion and a pair of connectors each having a conductive shield shell for covering a connector housing used to accommodate a terminal metal part, and which allows the shield shell to contact with the connector attachment portion so that noise or the like is grounded.

2. Description of the Related Art

Various electronic devices are mounted to an automobile that is a moving vehicle. For this reason, the automobile is provided with a wire harness in order to supply a signal or a power to the above-described electronic devices. Such a wire harness includes plural electric wires and connectors attached to the electric wires.

In the above-described automobile, for example, an electric automobile, a hybrid automobile, or a fuel-cell automobile, a driving motor may be configured as a three-phase AC motor. However, since a power having a high voltage is supplied to this kind of driving motor, a problem arises in that electric noise leaks to the outside from a terminal metal part of a connector used to supply a power to the above-described motor or electric noise flows from the terminal metal part to another terminal metal part.

As a technique for solving such problems, for example, a shield connector (for example, see Patent Document 1) is proposed. The shield connector includes an insulating connector housing which includes a terminal accommodation portion for accommodating a terminal metal part and an outer housing disposed on the outside of the terminal accommodation portion; a conductive inner shield shell which covers the terminal accommodation portion; and a conductive outer shield shell which is formed as a member separate from the inner shield shell and contacts with the inner shield shell so as to cover the outer housing. In addition, one ends of the inner shield shell and the outer shield shell are grounded.

A shield connector which is opposed to the shield connector so as to be fitted thereto includes, for example, an insulating connector housing which has a terminal accommodation portion for accommodating a terminal metal part; and a conductive shield shell which covers the connector housing. When the shield connectors are fitted to each other, the shield shell is electrically connected to the inner shield shell. Subsequently, electric noise leaking to the outside from the terminal metal part or electric noise entering the terminal metal part is changed to a return current. After the return current flows from the shield shell to the inner shield shell, the return current flows from the inner shield shell or the inner shield shell and the outer shield shell so as to be discharged to the outside.

Patent Document 1: JP-A-2006-310164

However, since a part of the above-described electric noise flows from the shield shell of the opposed shield connector to the outer shield shell via the inner shield shell of the shield connector so as to be discharged to the outside, a path from the shield shell to the outer shield shell becomes long, and a return current cannot flow due to an electric resistance in the path, thereby causing a problem in that electric noise cannot be sufficiently discharged.

SUMMARY OF THE INVENTION

The present invention aims to solve the above-described problems. That is, an object of the invention is to provide a shield connector structure capable of exhibiting a more satisfactory shield performance by shortening a path, through which a return current flows, so as to effectively discharge noise.

In order to solve the above-described problems and to achieve the above-described object, according to a first aspect of the invention, there is provided a shield connector structure including: a pair of connectors which is capable of being fitted to each other and each includes a terminal metal part, an insulating connector housing including a terminal accommodation portion for accommodating the terminal metal part, and a conductive shield shell for covering at least the terminal accommodation portion of the connector housing; and a conductive connector attachment portion which is connected to the shield shell of at least one connector so as to ground the shield shell, wherein when the connectors are fitted to each other, the shield shells are shield-connected to each other, and wherein both shield shells of the pair of connectors each includes a shell body which covers at least the terminal accommodation portion and a connection portion which is connected to the shell body and is connected to the connector attachment portion when the connectors are fitted to each other.

A second aspect of the invention provides the shield connector structure according to the first aspect, wherein at least one of the connection portions is provided so as to protrude toward the connector attachment portion and comes into contact with the connector attachment portion so as to be elastically deformed and to press the connector attachment portion by means of an elastic restoring force when the connectors are fitted to each other.

According to a third aspect of the invention, there is provided a shield connector structure including: a pair of connectors which is capable of being fitted to each other and each includes a terminal metal part, an insulating connector housing including a terminal accommodation portion for accommodating the terminal metal part, and a conductive shield shell for covering at least the terminal accommodation portion of the connector housing; and a conductive connector attachment portion which is connected to the shield shell of one connector so as to ground the shield shell, wherein when the connectors are fitted to each other, the shield shells are shield-connected to each other, and wherein the connector housing of one connector includes a terminal accommodation portion and an outer housing which is disposed on the outside of the terminal accommodation portion, wherein the shield shell of one connector includes: a shell body which includes an inner shield shell which covers the terminal accommodation portion and an outer shield shell which is formed as a member separate from the inner shield shell and contacts with the inner shield shell so as to cover the outer housing; and a connection portion which is connected to the shell body and is connected to the connector attachment portion, and wherein a second connection portion is provided in one of the outer shield shell and the shield shell of the other connector so as to be connected to the other shield shell.

A fourth aspect of the invention provides the shield connector structure according to the third aspect, wherein the second connection portion is provided so as to protrude from one of the outer shield shell and the shield shell of the other connector to the other shield shell, and comes into contact with the other shield shell so as to be elastically deformed and to press the other shield shell by means of an elastic restoring force when the connectors are fitted to each other.

A fifth aspect of the invention provides the shield connector structure according to the fourth aspect, wherein a hole portion is provided so as to pass through the outer housing of the one connector and to allow the second connection portion to pass therethrough.

A sixth aspect of the invention provides the shield connector structure according to the fifth aspect, wherein the connector housing of the other connector includes a terminal accommodation portion and an outer housing which is disposed on the outside of the terminal accommodation portion, and a second hole portion which is provided so as to pass through the outer housing of the other connector and to allow the second connection portion to pass therethrough.

A seventh aspect of the invention provides the shield connector structure according to any one of the first to sixth aspects, wherein the connection portion protrudes from the shell body, and wherein a width of the base end of the connection portion in a direction intersecting the protruding direction of the connection portion is set to be equal to a width of the shell body in the intersection direction.

An eighth aspect of the invention provides the shield connector structure according to the seventh aspect, wherein the connection portion is formed in a trapezoid shape in which the width becomes narrow toward the front end.

According to the first aspect of the invention, since both shield shells of the pair of connectors respectively include the connection portions which are connected to the connector attachment portion when the connectors are fitted to each other, the noise shielded by the respective shield shells is changed to a return current which directly flows to the connector attachment portion so as to be discharged to the outside.

According to the second aspect of the invention, since one of the connection portions is provided so as to protrude toward the connector attachment portion and comes into contact with the connector attachment portion so as to be elastically deformed and to press the connector attachment portion by means of an elastic restoring force when the connectors are fitted to each other, the connection portion is reliably connected to the connector attachment portion.

According to the third aspect of the invention, since the second connection portion is provided in one of the outer shield shell and the shield shell of the other connector so as to be connected to the other shield shell, the noise shielded by the shield shell of the other connector is changed to a return current which flows to the connector attachment portion via the outer shield shell of one connector so as to be discharged to the outside.

According to the fourth aspect of the invention, since the second connection portion is provided so as to protrude from one of the outer shield shell and the shield shell of the other connector to the other shield shell, and comes into contact with the other shield shell so as to be elastically deformed and to press the other shield shell by means of an elastic restoring force when the connectors are fitted to each other, the second connection portion is reliably connected to the outer shield shell (or the shield shell of the other connector).

According to the fifth aspect of the invention, since the hole portion is provided so as to pass through the outer housing of the one connector and to allow the second connection portion to pass therethrough, the second connection portion is connected to the outer shield shell of one connector (or the shield shell of the other connector) via the hole portion.

According to the sixth aspect of the invention, since the connector housing of the other connector includes a terminal accommodation portion and an outer housing which is disposed on the outside of the terminal accommodation portion, and the second hole portion which is provided so as to pass through the outer housing of the other connector and to allow the second connection portion to pass therethrough, the second connection portion is connected to the outer shield shell of one connector (or the shield shell of the other connector) via the second hole portion.

According to the seventh aspect of the invention, since the connection portion protrudes from the shell body, and a width of the base end of the connection portion in a direction intersecting the protruding direction of the connection portion is set to be equal to a width of the shell body in the intersection direction, the width of the base end of the connection portion in the intersection direction becomes wide. In addition, a contact area of the connection portion contacting with the connector attachment portion becomes wide without suddenly increasing an electric resistance in the path from the shell body to the connection portion, thereby reducing a contact resistance.

According to the eighth aspect of the invention, since the connection portion is formed in a trapezoid shape in which the width becomes narrow toward the front end, the front end of the connection portion is formed to have an obtuse angle, and a return current flowing to the connection portion easily flows to the connection attachment portion compared with the case where the front end is formed to have a right angle, thereby making the electric field distribution uniform.

According to the first aspect of the invention, since both shield shells of the pair of connectors respectively include the connection portions which are connected to the connector attachment portion when the connectors are fitted to each other, the noise shielded by the respective shield shells is changed to a return current which directly flows to the connector attachment portion so as to be discharged to the outside. Accordingly, it is possible to exhibit a satisfactory shield performance by shortening a path, through which a return current flows, so as to effectively discharge the noise.

According to the second aspect of the invention, since one of the connection portions is provided so as to protrude toward the connector attachment portion and comes into contact with the connector attachment portion so as to be elastically deformed and to press the connector attachment portion by means of an elastic restoring force when the connectors are fitted to each other, the connection portion is reliably connected to the connector attachment portion. Accordingly, it is possible to exhibit a satisfactory shield performance by reliably discharging the noise.

According to the third aspect of the invention, since the second connection portion is provided in one of the outer shield shell and the shield shell of the other connector so as to be connected to the other shield shell, the noise shielded by the shield shell of the other connector is changed to a return current which flows to the connector attachment portion via the outer shield shell of one connector so as to be discharged to the outside. Accordingly, it is possible to exhibit a satisfactory shield performance by shortening a path, through which a return current flows, so as to effectively discharge the noise.

According to the fourth aspect of the invention, since the second connection portion is provided so as to protrude from one of the outer shield shell and the shield shell of the other connector to the other shield shell, and comes into contact with the other shield shell so as to be elastically deformed and to press the other shield shell by means of an elastic restoring force when the connectors are fitted to each other, the second connection portion is reliably connected to the outer shield shell (or the shield shell of the other connector). Accordingly, it is possible to exhibit a satisfactory shield performance by reliably discharging the noise.

According to the fifth aspect of the invention, since the hole portion is provided so as to pass through the outer housing of the one connector and to allow the second connection portion to pass therethrough, the second connection portion is connected to the outer shield shell of one connector (or the shield shell of the other connector) via the hole portion. Accordingly, it is possible to reliably connect the second connection portion to the outer shield shell (or the shield shell of the other connector).

According to the sixth aspect of the invention, since the second hole portion is provided so as to pass through the outer housing of the other connector and to allow the second connection portion to pass therethrough, the second connection portion is connected to the outer shield shell (or the shield shell of the other connector) via the second hole portion. Accordingly, it is possible to reliably connect the second connection portion to the outer shield shell (or the shield shell of the other connector).

According to the seventh aspect of the invention, since the connection portion protrudes from the shell body, and a width of the base end of the connection portion in a direction intersecting the protruding direction of the connection portion is set to be equal to a width of the shell body in the intersection direction, the width of the base end of the connection portion in the intersection direction becomes wide. In addition, a contact area of the connection portion contacting with the connector attachment portion becomes wide without suddenly increasing an electric resistance in the path from the shell body to the connection portion, thereby reducing a contact resistance. Accordingly, it is possible to exhibit a satisfactory shield performance by shortening a path, through which a return current flows, so as to effectively discharge the noise.

According to the eighth aspect of the invention, since the connection portion is formed in a trapezoid shape in which the width becomes narrow toward the front end, the front end of the connection portion is formed to have an obtuse angle, and a return current flowing to the connection portion easily flows to the connection attachment portion compared with the case where the front end is formed to have a right angle, thereby making the electric field distribution uniform. Accordingly, it is possible to exhibit a satisfactory shield performance by effectively discharging the noise.

DESCRIPTION OF THE PREFERRED EMBODIMENTS

Figure 1:
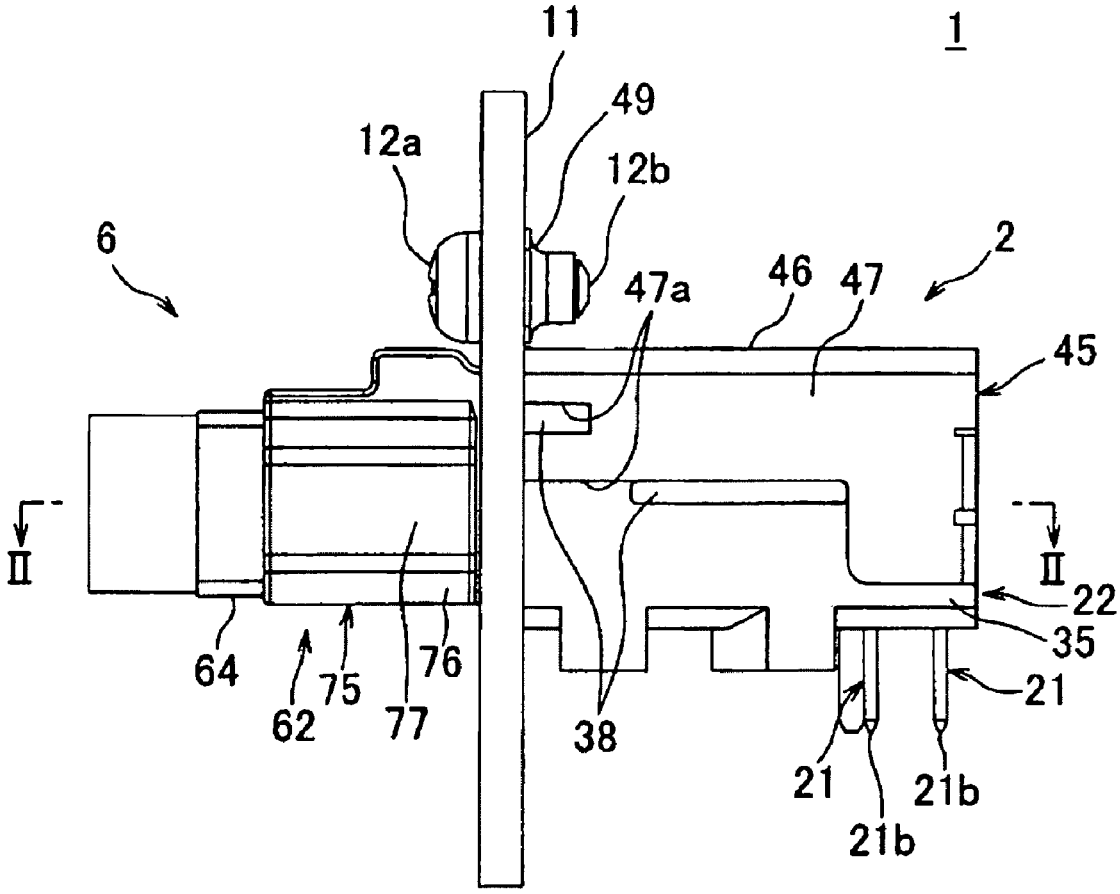
FIG. 1 is a side view showing a shield connector structure according to a first embodiment of the invention.

Hereinafter, a shield connector structure 1 according to a first embodiment of the invention will be described with reference to FIGS. 1 to 7. As shown in FIG. 1 and the like, the shield connector structure 1 according to the first embodiment of the invention includes a pair of connectors 2 and 6 which has shield shells 23 (shown in FIG. 7) and 63 (shown in FIG. 3) and is capable of being fitted to each other; and a conductive connector attachment portion 11 which contacts with the shield shell 23 of at least one connector 2 so as to ground the shield shell 23. When the connectors 2 and 6 are fitted to each other, the shield shells 23 and 63 are shield-connected to each other.

"The shield-connection" indicates the state where the shield shells 23 and 63 cover terminal metal parts 21 and 61, which are disposed in the shield shells 23 and 63 and are described below, in a whole circumferential direction. When the shield shells 23 and 63 are shield-connected to each other, electric noise leaking to the outside from the terminal metal parts 21 and 61 disposed inside the shield shells 23 and 63 or electric noise entering the shield shells 23 and 63 is reliably shielded by the shield shells 23 and 63.

Figure 2:
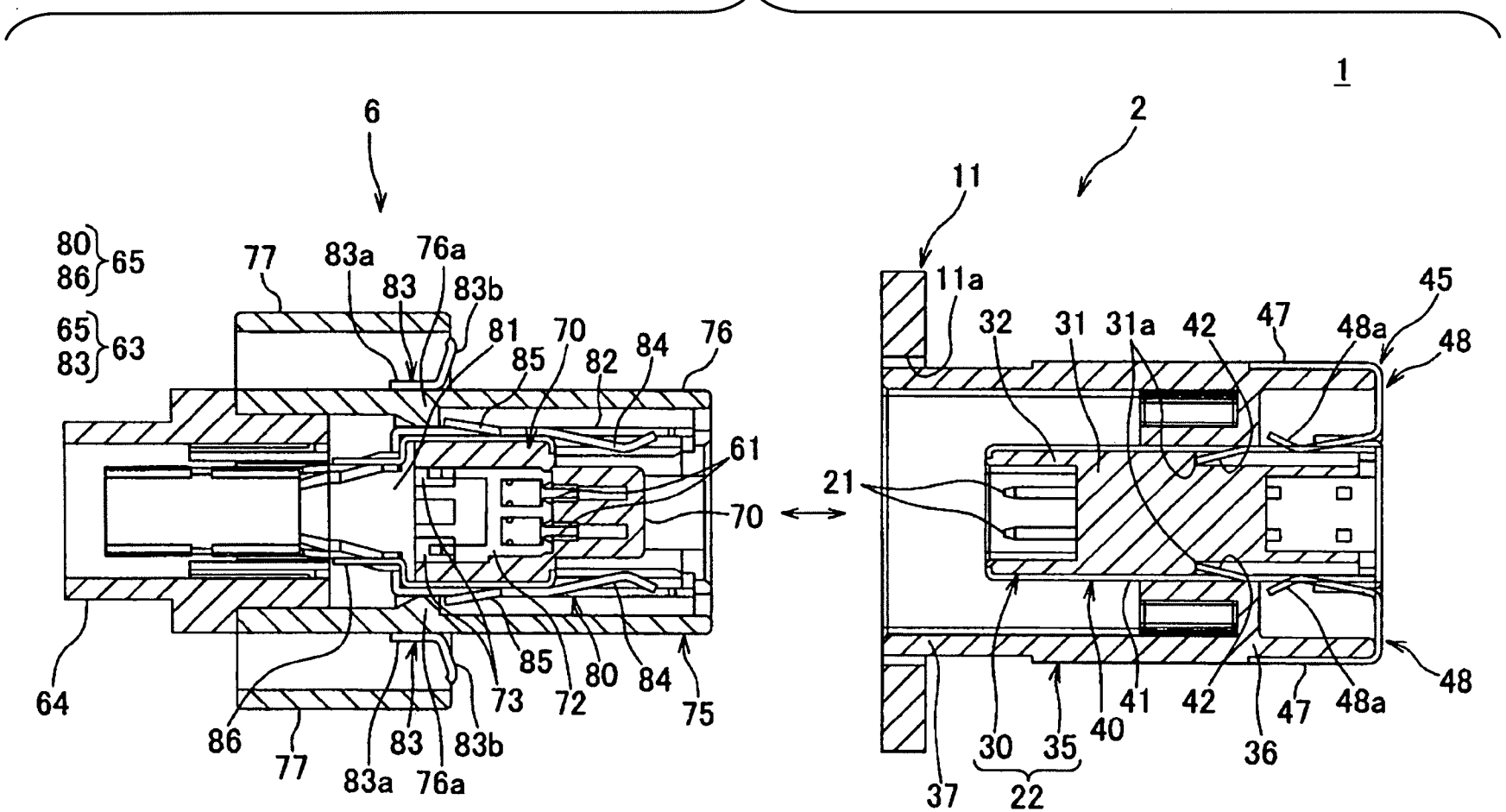
FIG. 2 is a sectional view showing a state before a pair of connectors shown in FIG. 1 is fitted to each other and taken along the line II-II of FIG. 1.
Figure 3:
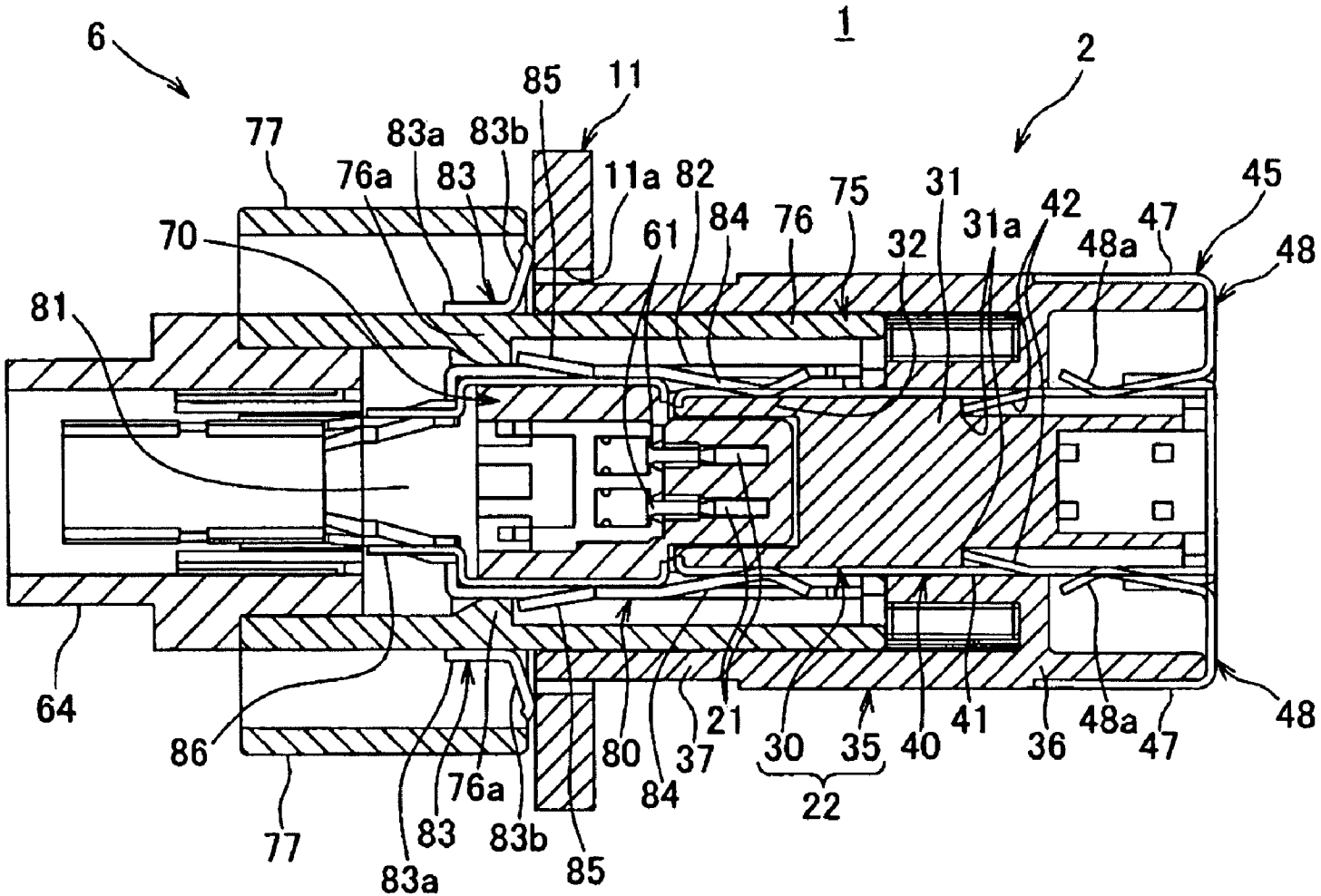
FIG. 3 is a sectional view showing a state where a pair of connectors shown in FIG. 2 is fitted to each other.

The connector attachment portion 11 is attached to a casing of an electronic device or the like. The connector attachment portion 11 is formed of a conductive metal material, and is formed in a flat-plate shape as shown in FIG. 2 and the like. The connector attachment portion 11 is provided with a hole 11*a* which allows one connector 2 to pass therethrough and a screw hole into which a below-described connection portion 49 of one connector 2 is inserted.

When the connectors 2 and 6 are fitted to each other so that the shield shells 23 and 63 are shield-connected to each other, the connector attachment portion 11 is connected to connection portions 49 and 83 which are provided in both shield shells 23 and 63 and are described below. Subsequently, electric noise leaking to the outside from the terminal metal parts 21 and 61 or electric noise entering the terminal metal parts is grounded to the electronic device via the shield shells 23 and 63 and the connector attachment portion 11 in a sequential order.

Figure 6:
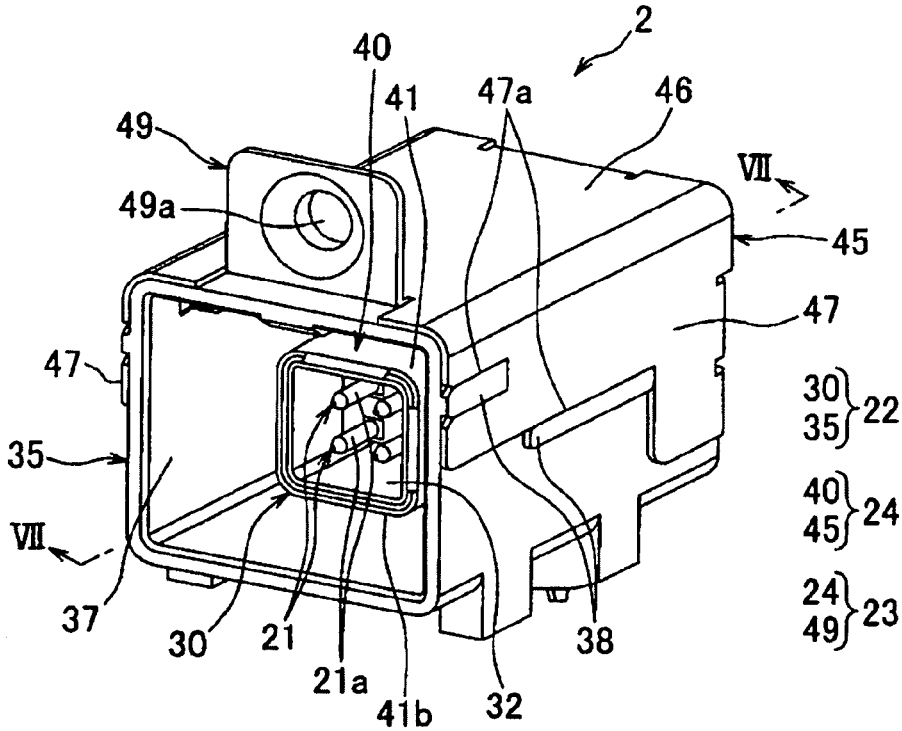
FIG. 6 is a perspective view showing one connector shown in FIG. 1.
Figure 7:
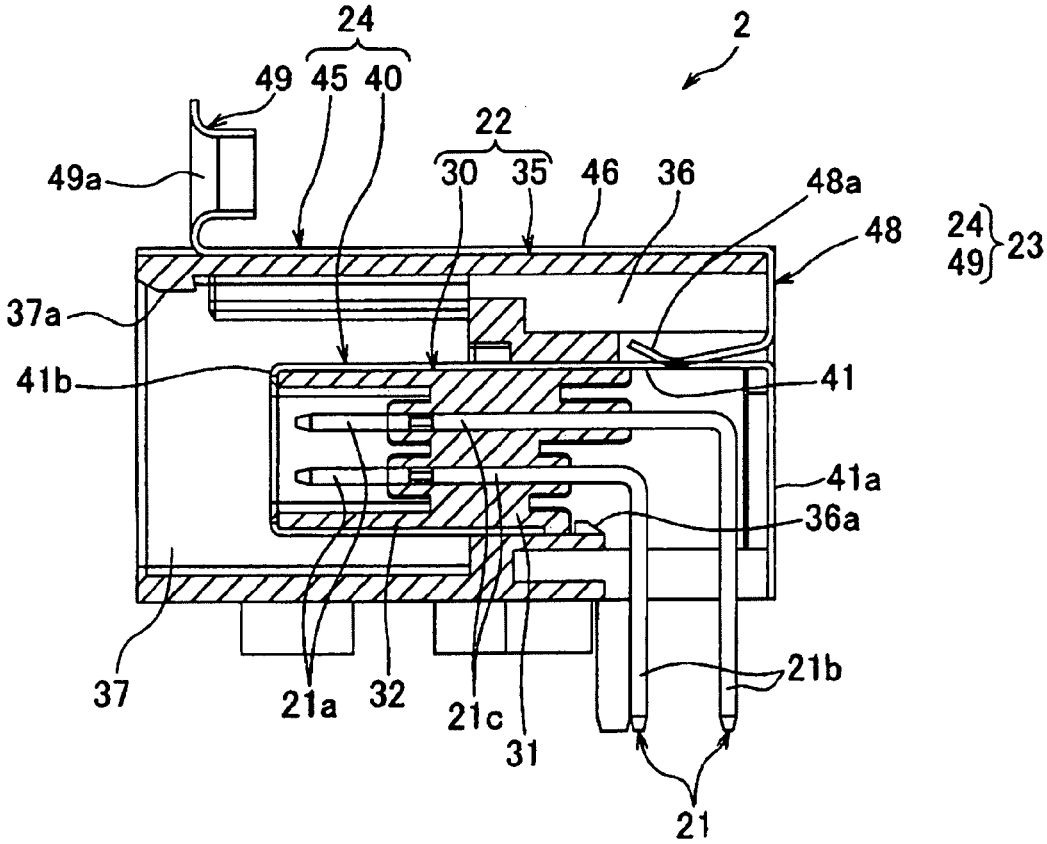
FIG. 7 is a sectional view taken along the line VII-VII of FIG. 6.

The pair of connectors 2 and 6 includes one connector 2 and the other connector 6. As shown in FIGS. 6 and 7, one connector 2 includes the terminal metal part 21; an insulating connector housing 22 which has a terminal accommodation portion 30 for accommodating the terminal metal part 21; and the conductive shield shell 23 which covers at least the terminal accommodation portion 30 of the connector housing 22.

The terminal metal part 21 is formed of a conductive metal material and is formed in an L-shaped bar shape. Plural terminal metal parts 21 are provided (in the example shown in the drawing, the number is four). The terminal metal part 21 includes an electric contact portion 21*a* which is provided in one end of the L-shaped bar shape and contacts with the other terminal metal part 21; a terminal portion 21*b* which is provided in the other end of the L-shaped bar shape and is exposed to the outside of the connector; and a holding portion 21*c* which is provided between the electric contact portion 21*a* and the terminal portion 21*b* and is held inside a body portion 31 of the terminal accommodation portion 30. The terminal metal part 21 is held inside the terminal accommodation portion 30 in the state where the electric contact portion 21*a* is parallel to the axis of the connector housing 22 and the terminal portion 21*b* is perpendicular to the axis of the connector housing 22.

As shown in FIGS. 6 and 7, the connector housing 22 includes the terminal accommodation portion 30 and an outer housing 35 which is disposed on the outside of the terminal accommodation portion 30. The terminal accommodation portion 30 is formed of an insulating synthetic resin or the like, and is formed in a substantially angular shape as a whole. The terminal accommodation portion 30 includes the body portion 31 which is provided in one end in a longitudinal direction and accommodates the holding portion 21*c* of the terminal metal part 21; and an inner hood portion 32 which is provided in the other end in a longitudinal direction and has the electric contact portion 21*a* of the terminal metal part 21 protruding therein. A pair of side surfaces of the body portion 31 is provided with a step portion 31*a* (shown in FIG. 2) which engages with a locking piece 42 of an inner shield shell 40 described below.

The outer housing 35 is formed of an insulating synthetic resin or the like, and is formed in a substantially angular shape as a whole. The outer housing 35 includes a body portion 36 which is provided in one end in a longitudinal direction and accommodates the terminal accommodation portion 30 attached with the inner shield shell 40 described below; an outer hood portion 37 which is provided in the other end in a longitudinal direction and has the terminal accommodation portion 30 protruding therein; and plural protrusion portions 38 which are provided in the outer surfaces of the body portion 36 and the outer hood portion 37 and engage with a notch portion 47*a* of an outer shield shell 45 described below.

An inner diameter of a part of the body portion 36 is set to be small so as to be substantially equal to an outer diameter of the inner shield shell 40. The inner surface away from the outer hood portion 37 of the body portion 36 is provided with a locking protrusion 36*a* that is formed in a convex shape and engages with the end of the terminal accommodation portion 30. In addition, the inner surface of the front end of the outer hood portion 37 is provided with a locking portion 37*a* that is provided in a convex shape and engages with a below-described locking arm 79 of the other connector 6.

As shown in FIGS. 6 and 7, the shield shell 23 includes a shell body 24 which has the inner shield shell 40 for covering the terminal accommodation portion 30 and the outer shield shell 45 formed in a member separate from the inner shield shell 40 and contacting with the inner shield shell 40 so as to cover the outer housing 35; and a connection portion 49 which is connected to the shell body 24 and is connected to the connector attachment portion 11.

The inner shield shell 40 is formed of a conductive metal material and is formed by bending, for example, a metal plate or the like. The inner shield shell 40 includes a tube portion 41 which overlaps with an outer peripheral surface of the terminal accommodation portion 30 and a pair of the locking pieces 42 (shown in FIG. 2) which is connected to the tube portion 41 and protrudes to the inside of the tube portion 41.

On end of the tube portion 41 in a longitudinal direction is opened so as to be in parallel with respect to the longitudinal direction. One end of the tube portion 41 in a longitudinal direction is provided with a curved portion 41*b* that is curved so as to be close to the tube portion 41. The other end of the tube portion 41 in a longitudinal direction is provided with a bent portion 41*a*. The other end thereof in a longitudinal direction is opened so as to be perpendicular to the longitudinal direction by means of the bent portion 41*a*.

The pair of locking pieces 42 is provided so that the axis of the tube portion 41 is positioned therebetween. Each locking piece 42 is formed in a band-plate shape in a direction in which the connectors 2 and 6 are attached to each other or separated from each other (fitted to each other or separated from each other), where one end on the side of the other connector 6 is a free end and the other end away from the other connector 6 is connected to the tube portion 41. One end of the locking piece 42 is elastically deformable so as to be close to the inner surface of the tube portion.

The terminal accommodation portion 30 is inserted into the inner shield shell 40 having the above-described configuration. Subsequently, the locking piece 42 of the inner shield shell 40 engages with the end 31*a* of the terminal accommodation portion 30 (shown in FIG. 2), and the curved portion 41*b* of the inner shield shell 40 engages with the front end of the inner hood portion 32 of the terminal accommodation portion 30 (shown in FIG. 7), thereby holding the terminal accommodation portion 30 inside the inner shield shell 40 (the inner shield shell 40 is mounted to the terminal accommodation portion 30). Subsequently, the inner shield shell 40 is disposed so as to cover the whole part of the terminal accommodation portion 30.

The outer shield shell 45 is formed of a conductive metal material and is formed by bending, for example, a metal plate or the like. The outer shield shell 45 includes an upper plate portion 46 which overlaps with the upper surface of the outer housing 35; a pair of side plate portions 47 which is connected to both ends of the upper plate portion 46 in a traverse direction and overlaps with the side surfaces of the outer housing 35; and folded portions 48 which are respectively provided in the upper plate portion 46 and the pair of side plate portions 47.

A gap between the pair of side plate portions 47 is set to be slightly smaller than a gap between the side surfaces of the outer hosing 35. The pair of side plate portions 47 is provided with plural notch portions 47*a* where the protrusion portions 38 of the outer housing 35 pass through.

Each folded portion 48 is connected to one ends of the upper plate portion 46 and the pair of side plate portions 47 in a longitudinal direction, and is folded from the one ends toward the inner surface of the outer shield shell 45. Accordingly, the folded portion 48 is formed in a substantially L-shape in a sectional view. The front end 48*a* of the folded portion 48 (i.e., a portion disposed in substantially parallel to the upper plate portion 46 or the pair of side plate portions 47) is elastically deformable so as to be close to the inner surface of the outer shield shell 45.

The outer shield shell 45 having the above-described configuration is attached to the outer housing 35 so that the protrusion portion 38 of the outer housing 35 passes through the inside of the notch portion 47*a*. Subsequently, the pair of side plate portions 47 sandwiches the outer housing 35 so that the outer shield shell 45 is held in the outer surface of the outer housing 35 (the outer shield shell 45 is mounted to the outer housing 35).

In the above-described one connector 2, the terminal accommodation portion 30 mounted with the inner shield shell 40 is inserted into the outer housing 35 mounted with the outer shield shell 45. Subsequently, the terminal accommodation portion 30 is held in a portion where an inner diameter of the body portion 31 is small. At this time, the front end 48*a* of the folded portion 48 of the outer shield shell 45 comes into contact with the outer surface of the inner shield shell 40 so as to be elastically deformed and to press the outer surface of the inner shield shell 40 by means of an elastic restoring force. Accordingly, the outer shield shell 45 comes into contact with the inner shield shell 40 and the terminal accommodation portion 30 is held inside the outer housing 35. In addition, the end of the terminal accommodation portion 30 comes into contact with the locking protrusion 36*a* of the outer housing 35, thereby preventing the terminal accommodation portion 30, which is disposed on the right side in FIG. 7, from coming off from the outer housing 35.

The connection portion 49 is provided on the side of the other end of the upper plate portion 46 in a longitudinal direction. The connection portion 49 is formed by bending the end of the upper plate portion 46 so as to be perpendicular to the upper plate portion 46. The connection portion 49 is formed in a substantially rectangular shape in a top view, and has a screw hole 49*a* which is provided in the center so as to perforate the connection portion 49. After the screw hole 49*a* of the connection portion 49 is disposed so as to communicate with the screw hole of the connector attachment portion 11, one connector 2 is screw-connected to the connector attachment portion 11 in advance by means of a bolt 12*a* and a nut 12*b*.

Figure 4:
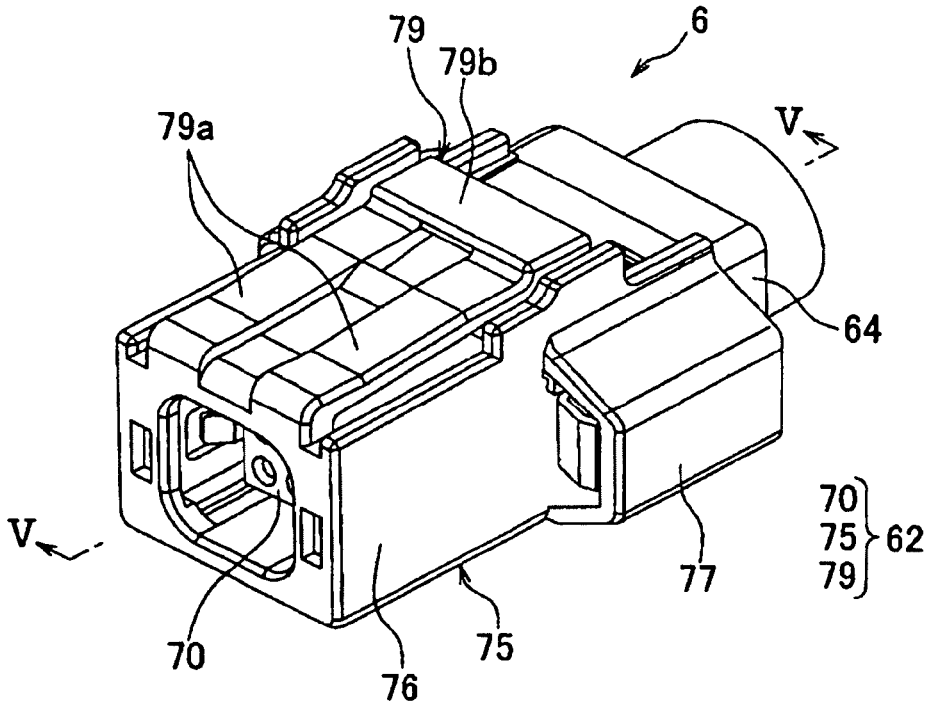
FIG. 4 is a perspective view showing the other connector shown in FIG. 1.
Figure 5:
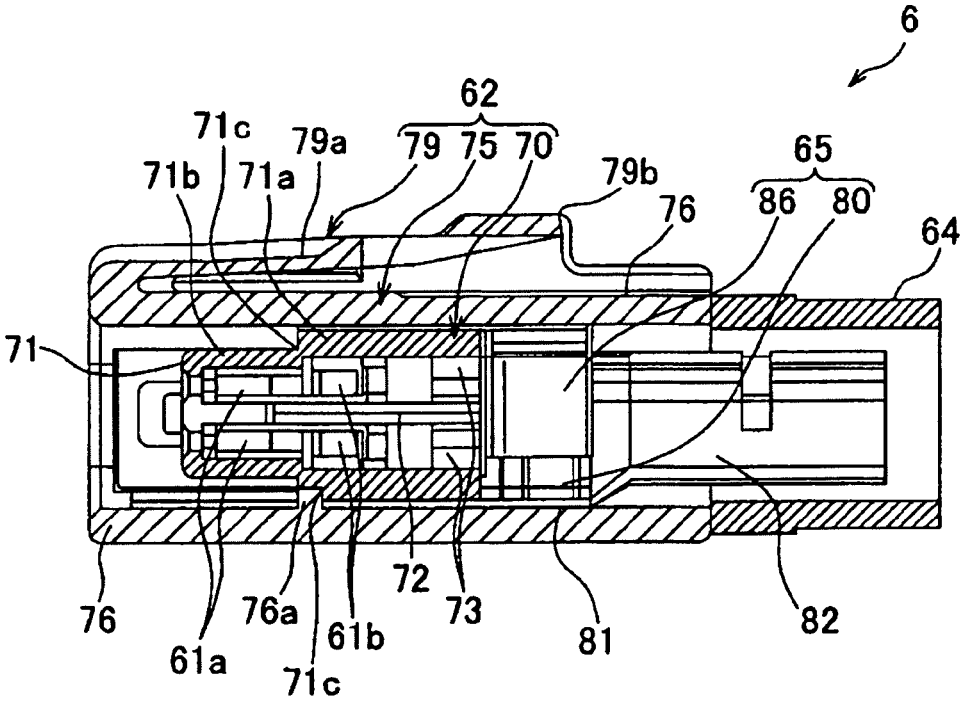
FIG. 5 is a sectional view taken along the line V-V of FIG. 4.

As shown in FIGS. 4 and 5, the other connector 6 includes the terminal metal part 61; an insulating connector housing 62 which has a terminal accommodation portion 70 for accommodating the terminal metal part 61; the conductive shield shell 63 which covers at least the terminal accommodation portion 70 of the connector housing 62; and a rear holder 64.

The terminal metal part 61 is formed by bending a conductive metal plate or the like. Plural terminal metal parts 61 are provided (in the example shown in the drawing, the number is four). The terminal metal part 61 includes an electric contact portion 61*a* which contacts with the terminal metal part 21 of one connector 2 and an electric wire connection portion 61*b* to which an electric wire is connected in a pressed state.

The electric connection portion 61*a* is formed in a tube shape, and is opened so as to correspond to the terminal metal part 21 of one connector 2. The electric contact portion 21*a* of the terminal metal part 21 of one connector 2 is inserted into the electric contact portion 61*a*, thereby electrically connecting the terminal metal parts 21 and 61 to each other. The electric wire connection portion 61*b* includes plural caulking pieces. The caulking pieces are used to caulk the terminal of the electric wire so as to electrically connect the electric wire connection portion 61*b* to a coil wire of the electric wire.

The connector housing 62 includes a terminal accommodation portion 70; an outer housing 75 which is disposed on the outside of the terminal accommodation portion 70; and a locking arm 79 which is connected to the outer housing 75.

The terminal accommodation portion 70 is formed of an insulating synthetic resin or the like. The terminal accommodation portion 70 includes a body portion 71 which is formed in a substantially angular tube shape; a thick flat-plate-shaped terminal holder 72 which is attached with the terminal metal part 61 and is held inside the body portion 71; and a tubular electric wire cover 73 which covers the electric wire connected to the terminal metal part 61.

The body portion 71 includes a large diameter portion 71*a* which is provided in one end in a longitudinal direction; a small diameter portion 71*b* which is provided in the other end in a longitudinal direction; a step portion 71*c* which is provided between the large diameter portion 71*a* and the small diameter portion 71*b* of the outer surface of the body portion 71. An outer diameter and an inner diameter of the large diameter portion 71*a* are set to be larger than those of the small diameter portion 71*b*. The large diameter portion 71*a* accommodates the terminal holder 72 and the electric wire cover 73. The outer surface of the large diameter portion 71*a* is mounted with a below-described upper shield shell 86 of the shield shell 63. The terminal metal part 61 is disposed in the area of the large diameter portion 71*a* and the small diameter portion 71*b*.

The outer housing 75 is formed in a substantially angular tube shape as a whole. The outer housing 75 includes a body portion 76 which accommodates the terminal accommodation portion 70 attached with the shield shell 63 and a pair of short tube portions 77 which is provided in the outer surface of the body portion 76 so as to have a tube shape.

The inner surface of the body portion 76 is provided with plural locking protrusions 76*a* that are provided in the inner surface so as to have a convex shape. The plural locking protrusions 76*a* engage with the step portion 71*c* of the body portion 71 of the terminal accommodation portion 70 and a locking piece 85 of a lower shield shell 80 described below.

The locking arm 79 is provided in the outer surface of the outer housing 75 in a protruding manner. The locking arm 79 includes an arm body 79*a* that is connected to the outer housing 75 and a locking portion 79*b* which is provided in the outer surface of the arm body 79*a* so as to have a convex shape.

A pair of the arm bodies 79*a* extends from one end of the outer housing 75 opposed to one connector 2 in a direction in which the connectors 2 and 6 are attached to each other and are separated from each other. The pair of arm bodies 79*a* is provided in parallel to each other so as to have a gap therebetween. The arm bodies 79*a* are elastically deformable so as to be close to the outer surface of the outer housing 75. The locking portion 79*b* is provided in the front end of the arm body 79*a* is connected to the pair of arm bodies 79*a* in a direction perpendicular to a longitudinal direction of the arm bodies 79*a*.

In the locking arm 79 having the above-described configuration, when the outer housing 75 of the other connector 6 is inserted into the outer housing 35 of one connector 2, the locking portion 79*b* comes into contact with the locking portion 37*a* provided in the outer housing 35 of one connector 2 so that the arm body 79*a* is elastically deformed so as to be close to the outer surface of the outer housing 75. Subsequently, when the locking portion 79*b* passes over the locking portion 37*a* of one connector 2, the arm body 79*a* is elastically restored and the locking portions 37*a* and 79*b* engage with each other, thereby holding the connectors 2 and 6 which are fitted to each other.

The shield shell 63 includes a shell body 65 which has the upper shield shell 86 and the lower shield shell 80 and covers at least the terminal accommodation portion 70 and the connection portion 83 which is connected to the shell body 65 and is connected to the connector attachment portion 11. The upper shield shell 86 is formed of a conductive metal material, and is formed by bending, for example, a metal plate or the like. The upper shield shell 86 is formed in a substantially gutter shape (having a U-shape in a sectional view) as a whole. A width of the upper shield shell 86 is set to be slightly smaller than a width of the large diameter portion of the terminal accommodation portion 70. The upper shield shell 86 is attached to the large diameter portion 71 a so as to cover the upper surface (the upside in FIG. 5) of the large diameter portion 71*a* of the terminal accommodation portion 70 and the pair of side surfaces.

The lower shield shell 80 is formed of a conductive metal material, and is formed by bending, for example, a metal plate or the like. The lower shield shell 80 includes a bottom plate portion 81 (shown in FIG. 2 and the like) which is formed in a band plate shape and a pair of side plate portions 82 (shown in FIG. 2 and the like) which is formed uprightly in both ends of the bottom plate portion 81 in a width direction, and is formed in an angular gutter shape (having a U-shape in a sectional view) as a whole. As shown in FIG. 2 and the like, the pair of side plate portions 82 includes a contact piece 84 and a locking piece 85.

The contact piece 84 is provided in each side plate portion 82 of the pair of side plate portions 82. The contact piece 84 is formed by cutting a part of the side plate portion 82 so as to be bent in a direction toward the inside of the lower shield shell 80. The contact piece 84 is formed in a band plate shape in a direction in which the connectors 2 and 6 are attached to each other or separated from each other, where one end on the side of one connector 2 is a free end and the other end away from one connector 2 is connected to the side plate portion 82. The contact piece 84 is bent at the center in a longitudinal direction, and a gap between the pair of contact pieces 84 is set so that a gap on the side of the base end and the front end is wide and a gap of the bent portion (center portion) is narrow. The contact pieces 84 are provided so as to be substantially in parallel to each other, and are elastically deformable in a direction in which a gap therebetween becomes wide.

When the connectors 2 and 6 are fitted to each other, the pair of contact pieces 84 having the above-described configuration is elastically deformed so as to position the inner shield shell 40 of one connector 2 therebetween and sandwiches the inner shield shell 40 therebetween by means of an elastic restoring force. Subsequently, the contact pieces 84 (i.e., the shield shell 63) are connected to the inner shield shell 40.

A pair of locking pieces 85 is provided in the outer surface of each side plate portion 82 of the pair of side plate portions 82 in a protruding manner. Each locking piece 85 is formed in a band plate shape in a direction in which the connectors 2 and 6 are attached to each other or separated from each other, where one end on the side of one connector 2 is connected to the side plate portion 82 and the other end away from one connector 2 is a free end. The other end of the locking piece 85 is elastically deformable so as to be close to the side plate portion 82. The locking piece 85 engages with the locking protrusion 76*a* of the outer housing 75.

One end of the lower shield shell 80 having the above-described configuration in a longitudinal direction is attached with the terminal accommodation portion 70 mounted with the upper shield shell 86. The lower shield shell 80 is attached thereto so as to cover the lower surface (the downside in FIG. 5) of the terminal accommodation portion 70 and the pair of side surfaces. Subsequently, the lower shield shell 80 and the upper shield shell 86 (i.e., the shell body 65) are disposed so as to cover the whole part of the terminal accommodation portion 70, that is, the whole part of the terminal metal part 61. The electric wire connected to the terminal metal part 61 is disposed in the other end of the lower shield shell 80 in a longitudinal direction.

A pair of connection portions 83 is provided in the outer surface of each side plate portion 82 of the pair of side plate portions 82 in a protruding manner. Each connection portion 83 includes a connection pin 83*a* that is connected to the side plate portion 82 and a connection piece 83*b* which is provided in the front end of the connection piece 83*a* so as to be perpendicular to the side plate portion 82 and is formed in a rectangular flat plate shape. The connection piece 83*b* is elastically deformable in a direction moving away from one end of the lower shield shell 80 in a longitudinal direction (i.e., a direction separated from the connection attachment portion 11). When the terminal accommodation portion 70 mounted with the lower shield shell 80 is inserted into the outer housing 75, the most part of the connection portion 83 is accommodated in the short tube portion 77 of the outer housing 75, and the connection piece 83*b* slightly protrudes from the short tube portion 77.

When the other connector 6 moves close to one connector 2, the connection portion 83 having the above-described configuration is disposed so as to protrude toward the connection attachment portion 11. Subsequently, when the connectors 2 and 6 are fitted to each other so that the inner shield shell 40 of one connector 2 is shield-connected to the shield shell 63 of the other connector 6, the connection piece 83*b* comes into contact with the connector attachment portion 11 so as to be elastically deformed and to press the connector attachment portion 11 by means of an elastic restoring force. Subsequently, the connection piece 83 (i.e., the shield shell 63) is connected to the connector attachment portion 11.

The rear holder 64 is attached to the end of the outer housing 75 away from one connector 2. The rear holder 64 is formed in an angular tube shape, and has therein the electric wire connected to the terminal metal part 61.

In the other connector 6 having the above-described configuration, the terminal accommodation portion 70 mounted with the upper shield shell 86 and the lower shield shell 80 (i.e., the shell body 65) is inserted into the outer housing 75. Subsequently, as shown in FIG. 5, the step portion 71*c* of the body portion 71 of the terminal accommodation portion 70 engages with the locking protrusion 76*a* of the outer housing 75, thereby preventing the terminal accommodation portion 70, which is located on the left side in FIG. 5, from coming off from the outer housing 75. In addition, as shown in FIG. 2, the locking piece 85 of the lower shield shell 80 engages with the locking protrusion 76*a* of the outer housing 75, thereby preventing the terminal accommodation portion 70, which is located on the left side in FIG. 2, from coming off from the outer housing 75.

At the time when the pair of connectors 2 and 6 having the above-described configurations engage with each other, first, one connector 2 is fixed to the connector attachment portion 11 by screw-connecting the connection portion 49 of one connector 2 to the connector attachment portion 11. Subsequently, the outer housing 75 of the other connector 6 is inserted into the outer housing 35 of one connector 2, and the small diameter portion 71*b* of the terminal accommodation portion 70 of the other connector 6 is inserted into the inner hood portion 32 of the terminal accommodation portion 30 of one connector 2.

Subsequently, the inner shield shell 40 of one connector 2 is sandwiched between the pair of contact pieces 84 of the lower shield shell 80 of the other connector 6, and the lower shield shell 80 contacts with the inner shield shell 40. When the other connector 6 moves closer to one connector 2, the connectors 2 and 6 are fitted to each other, and the terminal metal parts 21 and 61 are electrically connected to each other. At this time, the front end of the upper shield shell 86 contacts with the front end of the inner shield shell 40, and the upper shield shell 86 is shield-connected to the inner shield shell 40 (i.e., the shield shells 23 and 63).

In addition, at this time, the connection piece 83*b* of the connection portion 83 provided in the lower shield shell 80 of the other connector 6 comes into contact with the connector attachment portion 11 so as to be elastically deformed and to press the connector attachment portion 11 by means of an elastic restoring force, thereby connecting the connection portion 83 of the other connector 6 to the connector attachment portion 11.

As described above, in the pair of connectors 2 and 6 fitted to each other, noise shielded by the inner shield shell 40 of one connector 2 is grounded to the electronic device via the outer shield shell 45, the connection portion 49, and the connector attachment portion 11 in a sequential order. In addition, noise shielded by the shield shell 63 of the other connector 6 is grounded to the electronic device via the connection portion 83 and the connector attachment portion 11 in a sequential order. Likewise, the noise shielded by the inner shield shell 40 and the shield shell 63 is directly grounded to the electronic device without passing through the shield shell of the other connector.

According to this embodiment, since both shield shells 23 and 63 of the pair of connectors 2 and 6 respectively include the connection portions 49 and 83 which are connected to the connector attachment portion 11 when the connectors 2 and 6 are fitted to each other, the noise shielded by the respective shield shells 23 and 63 is changed to a return current which directly flows to the connector attachment portion 11 so as to be discharged to the outside. Accordingly, it is possible to exhibit a satisfactory shield performance by shortening a path, through which a return current flows, so as to effectively discharge the noise.

Since the connection portion 83 is provided so as to protrude toward the connector attachment portion 11 and comes into contact with the connector attachment portion 11 so as to be elastically deformed and to press the connector attachment portion 11 by means of an elastic restoring force when the connectors 2 and 6 are fitted to each other, the connection portion 83 is reliably connected to the connector attachment portion 11. Accordingly, it is possible to exhibit a satisfactory shield performance by reliably discharging the noise.

Next, the shield connector structure 1 according to a second embodiment of the invention will be described with reference to FIGS. 8 to 14. The same reference numerals are given to the same components as those of the first embodiment, and the description thereof will be omitted.

Figure 8:
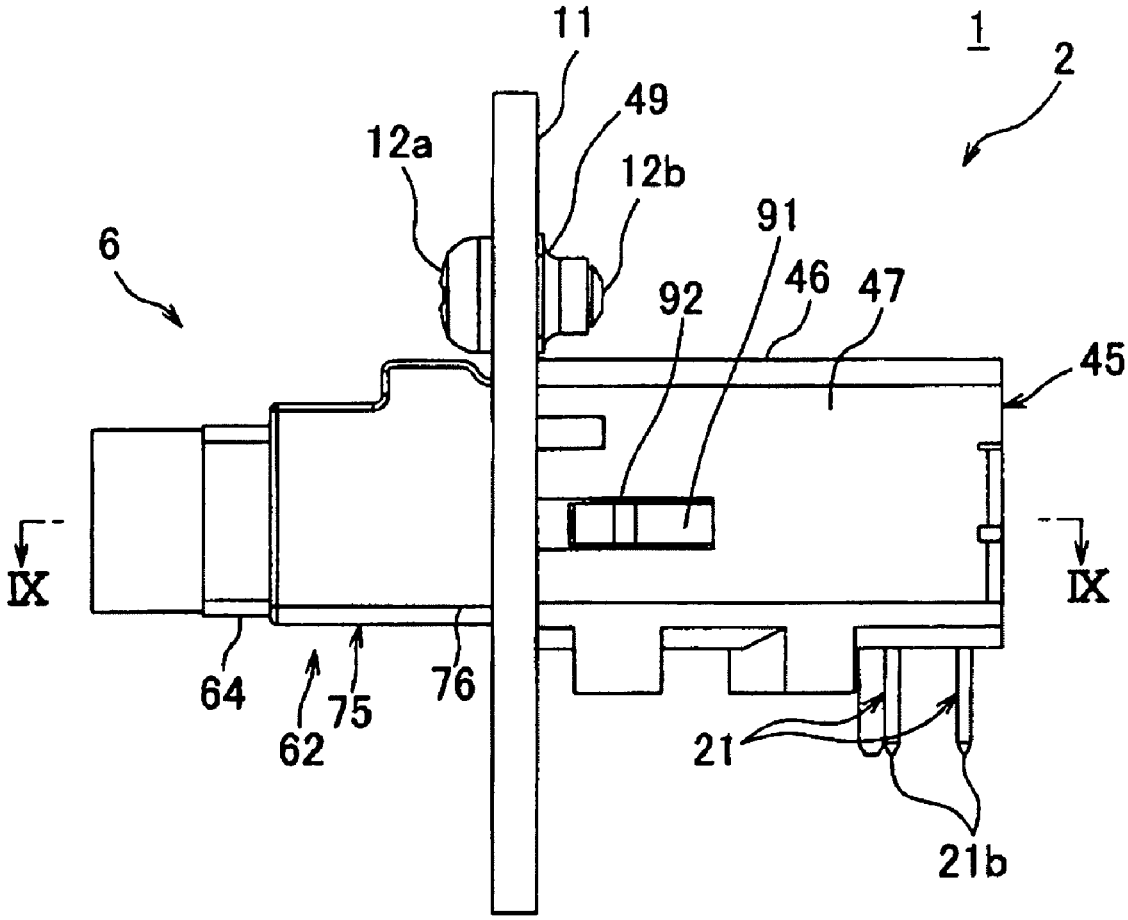
FIG. 8 is a side view showing the shield connector structure according to a second embodiment of the invention.

As shown in FIG. 8 and the like, the shield connector structure according to the second embodiment of the invention includes the pair of connectors 2 and 6 which has the shield shells 23 (shown in FIG. 14) and 63 (shown in FIG. 10) and is capable of being fitted to each other; and the conductive connector attachment portion 11 which contacts one shield shell 23 so as to ground the shield shell 23. When the connectors 2 and 6 are fitted to each other, the shield shells 23 and 63 are shield-connected to each other.

In this embodiment, unlike the first embodiment, the connection portion 83 is not provided in the lower shield shell 80 of the other connector 6, but a second connection portion 91 is provided in the outer shield shell 45 of one connector 2.

Figure 9:
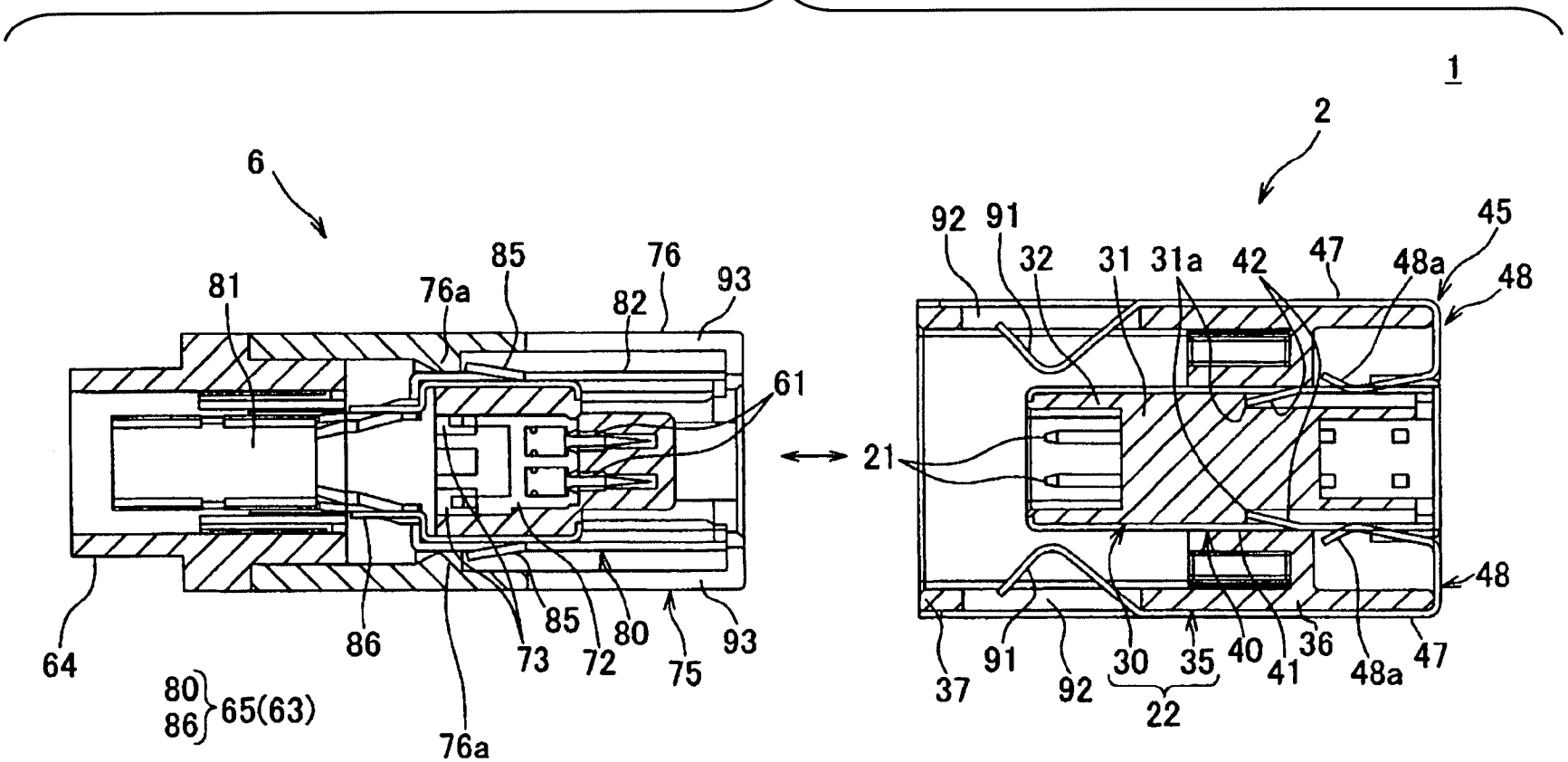
FIG. 9 is a sectional view showing a state before a pair of connectors shown in FIG. 8 is fitted to each other and taken along the line IX-IX of FIG. 8.
Figure 10:
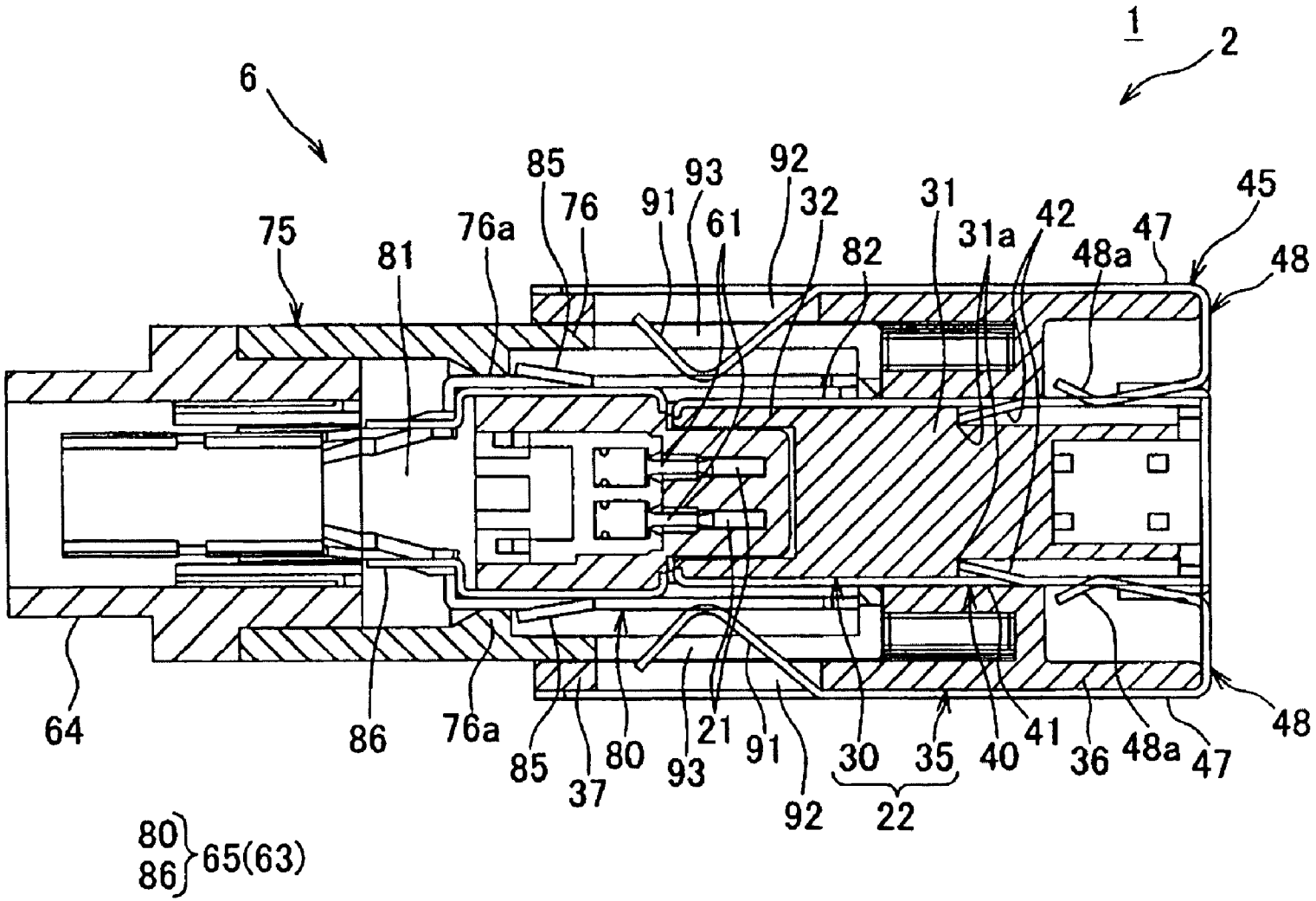
FIG. 10 is a sectional view showing a state where a pair of connectors shown in FIG. 9 is fitted to each other.
Figure 13:
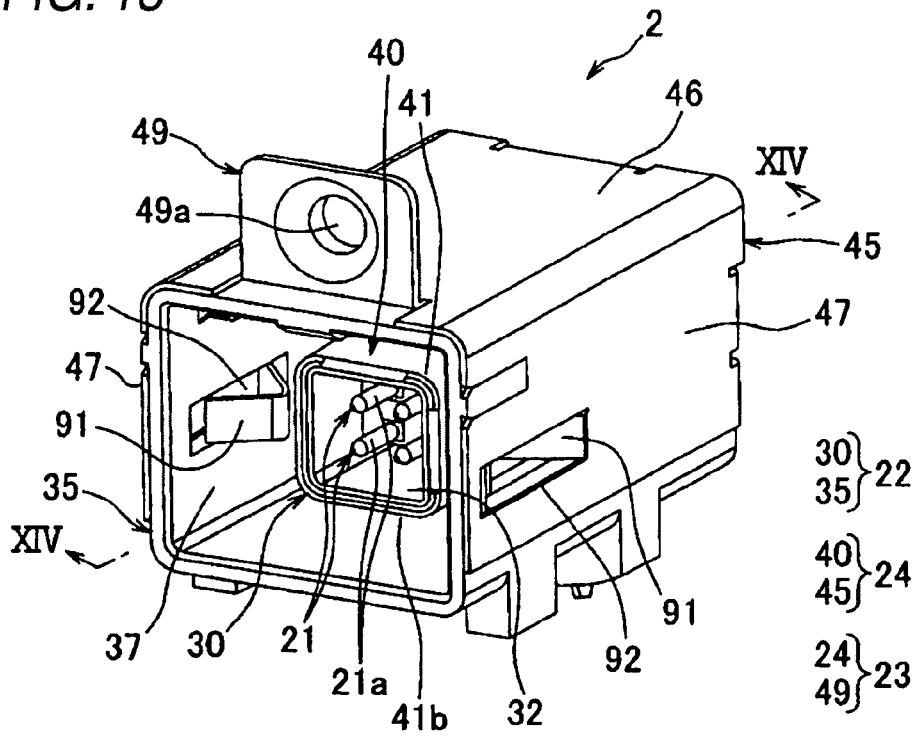
FIG. 13 is a perspective view showing one connector shown in FIG. 8.
Figure 14:
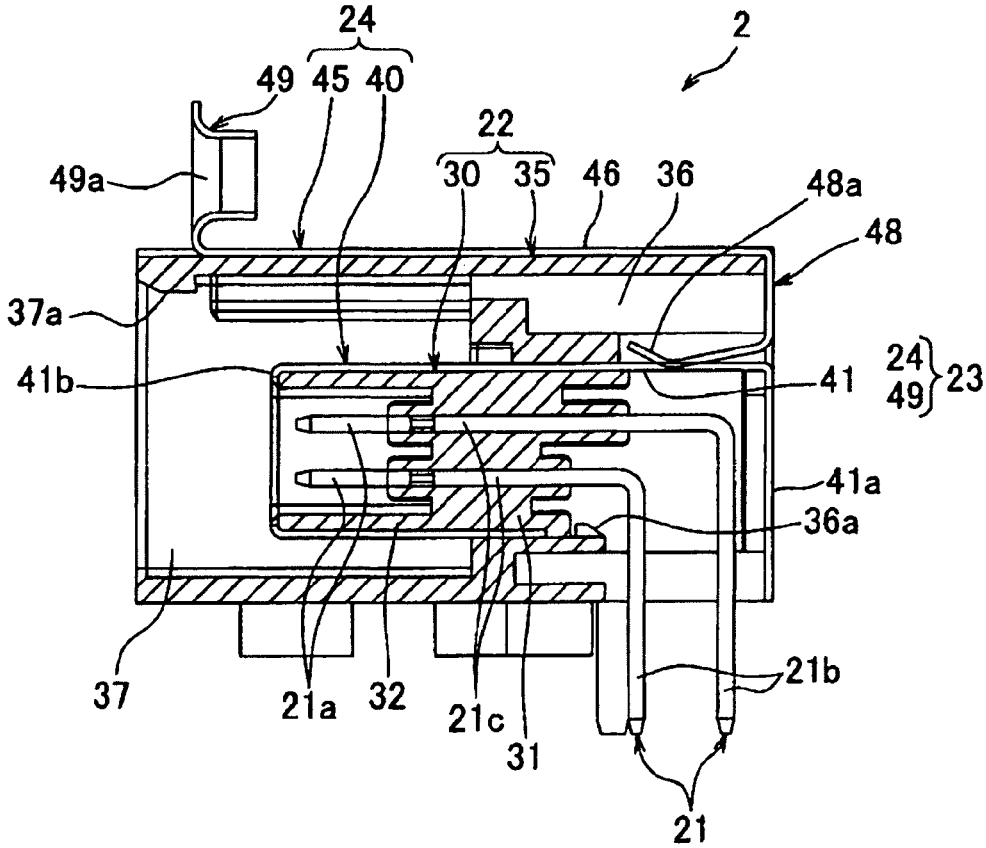
FIG. 14 is a sectional view taken along the line XIV-XIV of FIG. 13.

As shown in FIGS. 9 and 13, the second connection portion 91 is provided in each side plate portion 47 of the pair of side plate portions 47 of the outer shield shell 45. The second connection portion 91 is formed by cutting a part of the side plate portion 47 so as to be bent toward the inside of the outer shield shell 45. The second connection portion 91 is formed in a band plate shape in a direction in which the connectors 2 and 6 are fitted to each other, where one end on the side of the other connector 6 is a free end and the other end away from the other connector 6 is connected to the side plate portion 47. The second connection portion 91 is bent at the center in a longitudinal direction, and a gap between the pair of second connection portions 91 is set so that a gap on the side of the base end and the front end is wide and a gap of the bent portion (center portion) is narrow. A pair of the second connection portions 91 is opposed to each other so as to have a gap therebetween, and is elastically deformable so as to be close to the side plate portion 47 (in a direction in which a gap therebetween becomes wide).

In addition, the inside of the outer housing 35 of one connector 2 is provided with a hole portion 92 which passes through the second connection portion 91. The hole portion 92 is formed in a linear shape in a direction in which the connectors 2 and 6 are attached to each other and separated from each other and is formed so as to pass through the outer hood portion 37 of the outer housing 35. A pair of the hole portions 92 is provided at a position corresponding to the pair of second connection portions 91. Each second connection portion 91 is disposed inside the outer housing 35 in a protruding manner by means of each hole portion 92.

Figure 11:
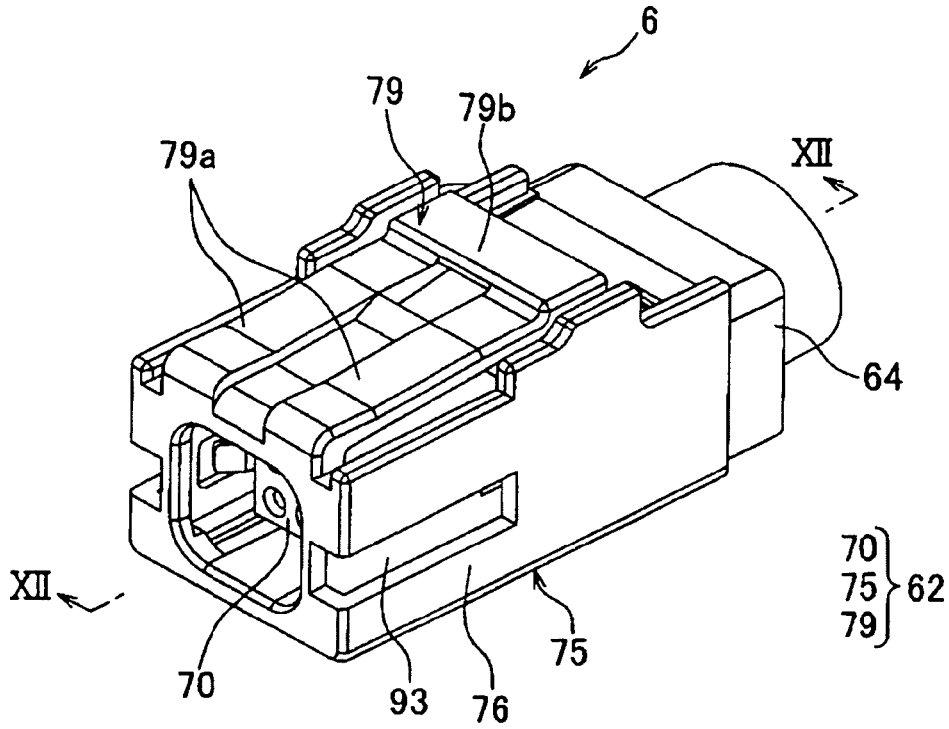
FIG. 11 is a perspective view showing the other connector shown in FIG. 8.
Figure 12:
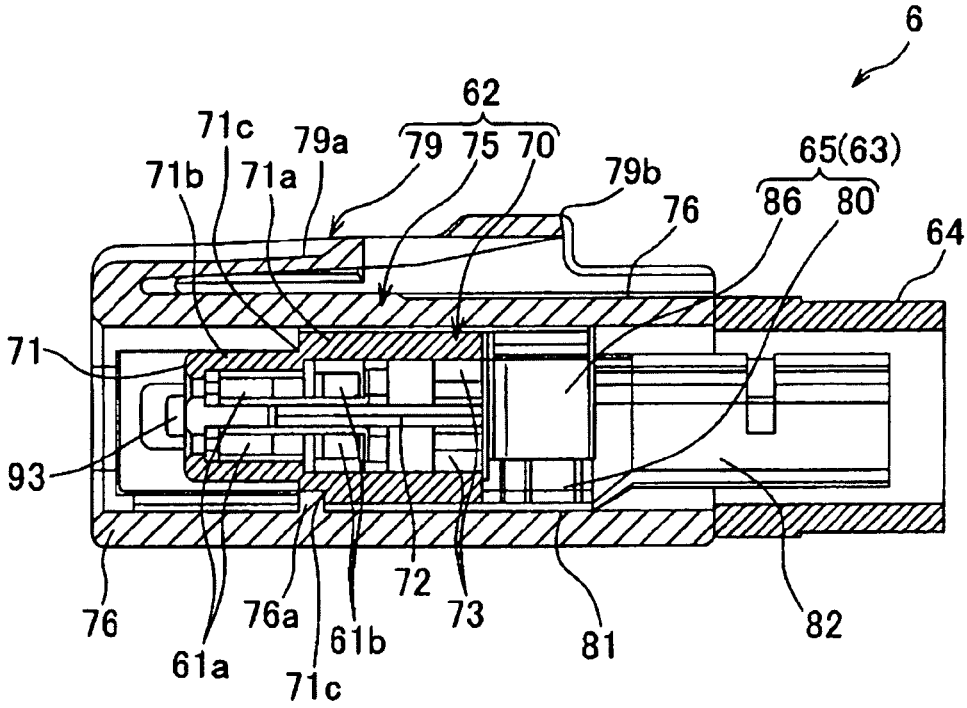
FIG. 12 is a sectional view taken along the line XII-XII of FIG. 11.

In addition, as shown in FIGS. 9 and 11, the outer housing 75 of the other connector 6 is provided with a second hole portion 93 which communicates with the hole portion 92 so that the second connection portion 91 passes therethrough when the connectors 2 and 6 are fitted to each other. The second hole portion 93 is formed in a linear shape from the end of the outer housing 75 opposed to one connector 2 in a direction in which the connectors 2 and 6 are attached to each other or separated from each other, and is formed so as to pass through the body portion 76 of the outer housing 75. A pair of the second hole portions 93 is provided at a position corresponding to the second connection portion 91. The lower shield shell 80 is exposed to the outside by means of the second hole portions 93.

Each second connection portion 91 having the above-described configuration protrudes to the inside of the outer housing 35 of one connector 2 via each hole portion 92. When the other connector 6 moves close to one connector 2, the second connection portion 91 is disposed so as to protrude toward the shield shell 63 (lower shield shell 80). Subsequently, when the connectors 2 and 6 move further so as to be close to each other, the second connection portions 91 are connected to the lower shield shell 80 via the second hole portion 93. Subsequently, the second connection portions 91 are elastically deformed so as to be close to the side plate portion 47 so as to position the lower shield shell 80 therebetween, and sandwiches the lower shield shell 80 therebetween by means of an elastic restoring force.

Subsequently, noise shielded by the inner shield shell 40 of one connector 2 is grounded to the electronic device via the outer shield shell 45, the connection portion 49, and the connector attachment portion 11 in a sequential order. In addition, noise shielded by the shield shell 63 of the other connector 6 is transmitted to one connector 2 via the second connection portion 91 of one connector 2, and is grounded to the electronic device via the outer shield shell 45 and the connector attachment portion 11 in a sequential order. Likewise, the noise shielded by the shield shell 23 of one connector 2 is directly grounded to the electronic device, and the noise shielded by the shield shell 63 of the other connector 6 is grounded to the electronic device via the outer shield shell 45 of one connector 2, that is, the shorter path.

According to this embodiment, since the second connection portion 91 is provided in the outer shield shell 45 so as to be connected to the lower shield shell 80 of the other connector 6, the noise shielded by the shield shell 63 of the other connector 6 is changed to a return current which flows to the connector attachment portion 11 via the outer shield shell 45 of one connector 2 so as to be discharged to the outside. Accordingly, it is possible to exhibit a satisfactory shield performance by shortening the path, through which a return current flows, so as to effectively discharge the noise.

Since the second connection portions 91 are provided so as to protrude from the outer shield shell 45 toward the lower shield shell 80 of the other connector 6 and come into contact with the lower shield shell 80 so as to be elastically deformed and to press the lower shield shell 80 by means of an elastic restoring force when the connectors 2 and 6 are fitted to each other, the second connection portions 91 are reliably connected to the lower shield shell 80. Accordingly, it is possible to exhibit a satisfactory shield performance by reliably discharging the noise.

Since the inside of the outer housing 35 of one connector 2 is provided with the hole portion 92 which passes through the second connection portion 91, the second connection portion 91 is connected to the lower shield shell 80 of the other connector 6 via the hole portion 92. Accordingly, it is possible to reliably connect the second connection portion 91 to the lower shield shell 80.

Since the second hole portion 93 is provided so as to pass through the outer housing 75 of the other connector 6 and to allow the second connection portion 91 to pass therethrough, the second connection portion 91 is connected to the lower shield shell 80 of the other connector 6 via the second hole portion 93. Accordingly, it is possible to reliably connect the second connection portion 91 to the lower shield shell 80.

In this embodiment, the second connection portion 91 is provided in the outer shield shell 45 of one connector 2. However, in this invention, the second connection portion 91 may be provided in the shield shell 63 (the upper shield shell 86 or the lower shield shell 80) of the other connector 6.

Next, the shield connector structure according to a third embodiment of the invention will be described with reference to FIGS. 15 and 16. In addition, the same reference numerals are given to the same components as those of the first embodiment, and the description thereof will be omitted.

Figure 15:
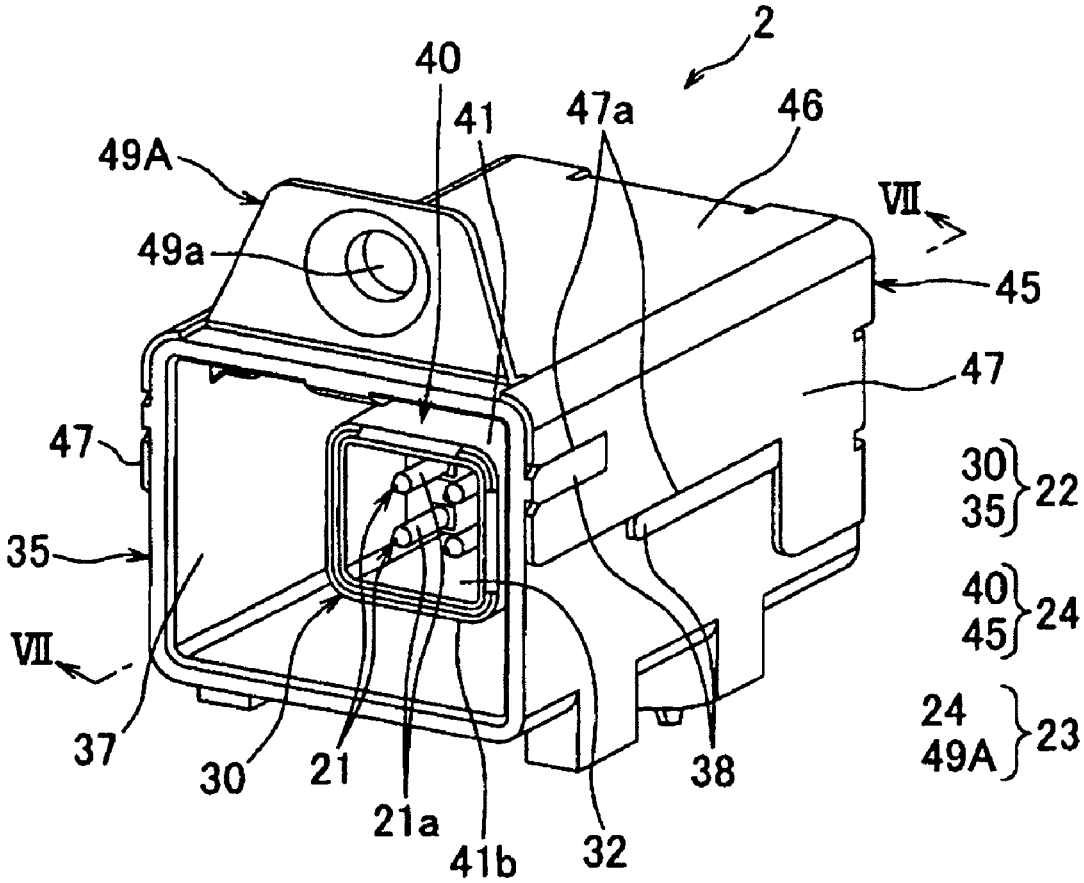
FIG. 15 is a perspective view showing one connector of the shield connector structure according to a third embodiment of the invention.
Figure 16:
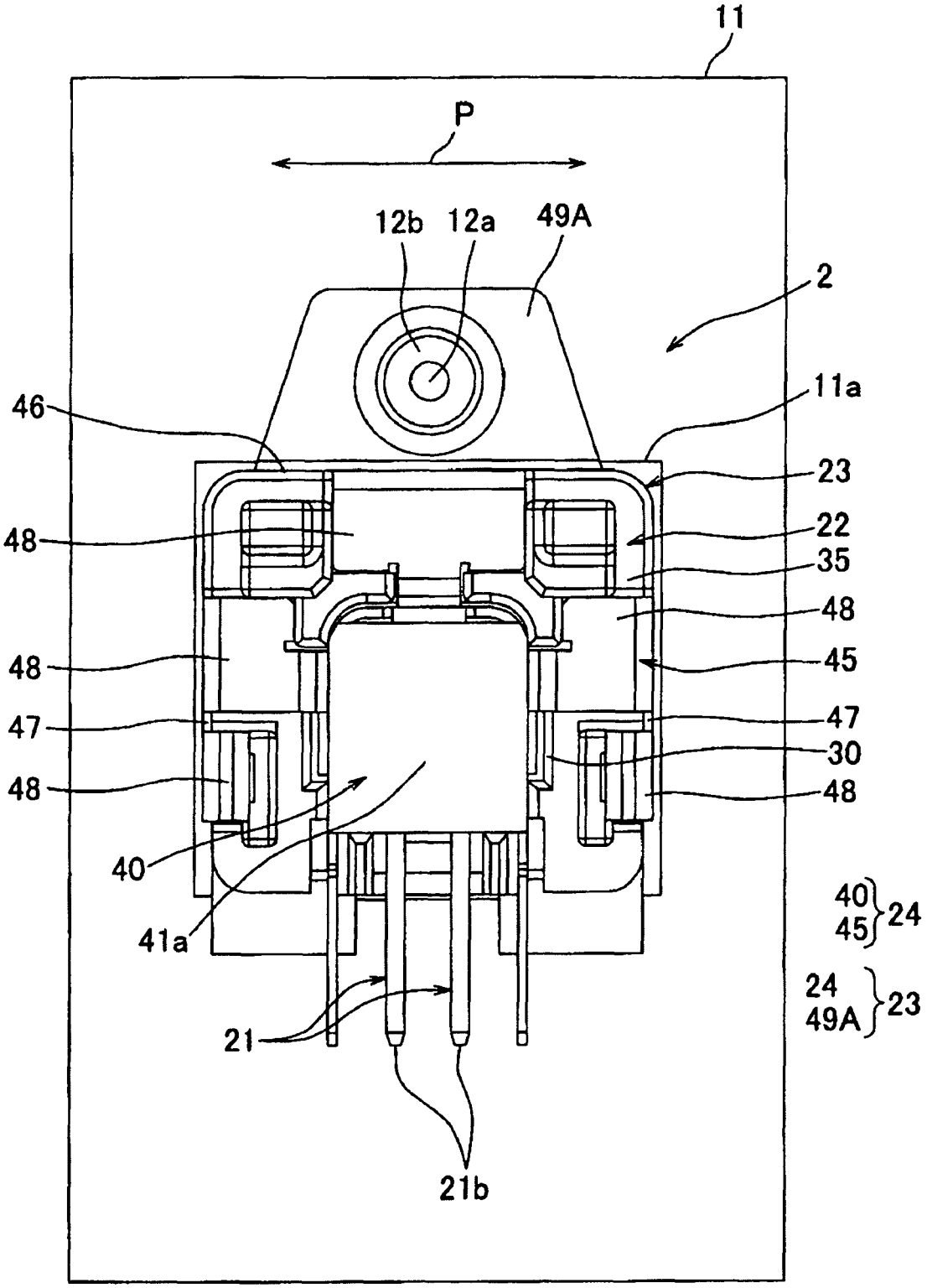
FIG. 16 is a rear view showing a state where one connector shown in FIG. 15 is fitted to a connector attachment portion by means of a screw.

As shown in FIG. 15, the shield connector structure according to the third embodiment of the invention includes a connection portion 49A which corresponds to the connection portion 49 (shown in FIG. 6) according to the first embodiment. The fact that the connection portion 49A is formed in a plane shape is different from the connection portion 49 according to the first embodiment.

The connection portion 49A is provided in the shield shell 23 of one connector 2. The connection portion 49A is provided so as to protrude from the outer shield shell 45 of the shell body 24. A width of the base end of the connection portion 49A in a direction P (shown in FIG. 16) perpendicular to (intersecting) a protruding direction of the connection portion 49A is substantially equal to a width of the shell body 24 in the perpendicular (intersection) direction P, that is, a width of the upper plate portion 46 of the outer shield shell 45 in the perpendicular (intersection) direction P. The connection portion 49A is formed in a trapezoid shape in which a width gradually becomes narrow in a direction from the base end to the front end.

In the connection portion 49A having the above-described configuration, compared with the connection portion 49 according to the first embodiment, a difference in width between the upper plate portion 46 and the connection portion 49A becomes small, and a variation in electric resistance in the path from the outer shield shell 45 to the connection portion 49A becomes small. In addition, compared with the connection portion 49 according to the first embodiment, a width of the base end of the connection portion 49A becomes wide, and a plane shape of the connection portion 49A becomes larger, thereby obtaining the larger contact area of the connection portion 49A which contacts with the connector attachment portion 11. In addition, the front end of the connection portion 49 according to the first embodiment is formed to have a right angle, but the front end of the connection portion 49A is formed to have an obtuse angle. Accordingly, since a return current easily flows to the connector attachment portion 11 via the connection portion 49A, and the electric field distribution becomes uniform, it is possible to restrict noise emitted to the outside.

According to this embodiment, in addition to the above-described advantage of the first embodiment, since the connection portion 49A is provided in the shell body 24 in a protruding manner, and the width of the base end of the connection portion 49A in a direction P perpendicular to (intersecting) the protruding direction of the connection portion 49A is substantially equal to the width of the shell body 24 in the perpendicular (intersection) direction P, the width of the connection portion 49A in the perpendicular (intersection) direction P becomes wide and the contact area of the connection portion 49A contacting with the connector attachment portion 11 becomes wide, thereby reducing a contact resistance. Accordingly, it is possible to exhibit a satisfactory shield performance by reducing an electric resistance in the path, through which a return current flows, so as to effectively discharge the noise.

Since the connection portion 49A is formed in a trapezoid shape in which a width gradually becomes narrow in a direction toward the front end, the front end of the connection portion 49A is formed to have an obtuse angle, and a return current flowing to the connection portion 49A easily flows to the connector attachment portion 11 compared with the case where the front end is formed to have a right angle, thereby obtaining the uniform electric field distribution. Accordingly, it is possible to exhibit a satisfactory shield performance by effectively discharging the noise.

In this embodiment, the connection portion 49 of one connector 2 according to the first embodiment is the connection portion 49A, but the connection portion 49 of one connector 2 according to the second embodiment may be the connection portion 49A. Further, the connection portion 83 of the other connector 6 according to the first embodiment may be formed in a plane shape which is the same as that of the connection portion 49A. Furthermore, the connection portion 49A does not have to be formed in a trapezoid shape so long as at least the width is wide to be equal to the width of the shell body 24.

Moreover, the above-described embodiments are exemplary embodiments of the invention, but the invention is not limited thereto. That is, various modifications can be made in a range without departing from the spirit of the invention.

What is claimed is:

1. A shield connector structure, comprising:

a pair of connectors fittable to each other and each including:

a terminal metal part, an insulating connector housing including a terminal accommodation portion for accommodating the associated terminal metal part, and a conductive shield shell for covering at least the associated terminal accommodation portion of the associated connector housing; and a conductive connector attachment portion to which a first one of the connectors is mounted and which is connected to the shield shell of the first connector, said connector attachment portion being attachable to an electronic device so as to ground the shield shell, wherein when the connectors are fitted to each other, the shield shells are shield-connected to each other, and wherein the shield shells respectively include shell bodies which cover the associated terminal accommodation portions and connection portions which are connected to the associated shell bodies and which contact the connector attachment portion when the connectors are fitted to each other.

2. The shield connector structure according to claim 1, wherein the connection portion of a second one of the connectors is provided so as to protrude toward the connector attachment portion and comes into contact with the connector attachment portion so as to be elastically deformed and to press the connector attachment portion by means of an elastic restoring force when the connectors are fitted to each other.

3. A shield connector structure, comprising:

a pair of connectors fittable to each other and each including:

a terminal metal part, an insulating connector housing including a terminal accommodation portion for accommodating the associated terminal metal part, and a conductive shield shell for covering at least the associated terminal accommodation portion of the associated connector housing; and a conductive connector attachment portion to which a first one of the connectors is mounted and which is connected to the shield shell of the first connector, said connector attachment portion being attachable to an electronic device so as to ground the shield shell, wherein when the connectors are fitted to each other, the shield shells are shield-connected to each other, and wherein the connector housing of the first connector includes an outer housing disposed on the outside of the terminal accommodation portion of the first connector, wherein the shield shell of the first connector includes:

a shell body which includes an inner shield shell which covers the terminal accommodation portion of the first connector and an outer shield shell which is formed as a member separate from the inner shield shell and contacts with the inner shield shell so as to cover the outer housing; and a connection portion which is connected to the shell body and is connected to the connector attachment portion, and wherein a second connection portion is provided on either the outer shield shell or the shield shell of a second one of the connectors so as to contact the other shield shell, selected from the outer shield shell and the shield shell of the second connector, which the second connection portion is not provided on.

4. The shield connector structure according to claim 3, wherein the second connection portion is provided so as to protrude from the shield shell that the second connection portion is provided on to the other shield shell, and comes into contact with the other shield shell so as to be elastically deformed and to press the other shield shell by means of an elastic restoring force when the connectors are fitted to each other.

5. The shield connector structure according to claim 4, wherein a hole portion is provided so as to pass through the outer housing of the first connector and to allow the second connection portion to pass therethrough.

6. The shield connector structure according to claim 5, wherein the connector housing of the second connector includes an outer housing which is disposed on the outside of the terminal accommodation portion of the second connector, and a second hole portion which is provided so as to pass through the outer housing of the second connector and to allow the second connection portion to pass therethrough.

7. The shield connector structure according to claim 1, wherein the connection portion of the first connector protrudes from the shell body of the first connector, and wherein a width of a base end of the connection portion of the first connector in a direction intersecting the protruding direction of the connection portion of the first connector is set to be equal to a width of the shell body of the first connector in the intersection direction.

8. The shield connector structure according to claim 3, wherein the connection portion of the first connector protrudes from the shell body of the first connector, and wherein a width of a base end of the connection portion of the first connector in a direction intersecting the protruding direction of the connection portion of the first connector is set to be equal to a width of the shell body of the first connector in the intersection direction.

9. The shield connector structure according to claim 8, wherein the connection portion of the first connector is formed in a trapezoid shape in which the width becomes narrow towards a front end of the connection portion of the first connector which is opposite the base end.

10. The shield connector structure according to claim 1, wherein the connector attachment portion is provided on a casing of an electronic device.

11. The shield connector structure according to claim 1, wherein the first connector is mounted to the connector attachment portion by a threaded member.

12. The shield connector structure according to claim 3, wherein the connector attachment portion is provided on a casing of an electronic device.

13. The shield connector structure according to claim 3, wherein the first connector is mounted to the connector attachment portion by a threaded member.

14. The shield connector structure according to claim 3, wherein the second connection portion is not integrally formed with and does not contact the inner shield shell when the connectors are fitted to each other.

15. The shield connector structure according to claim 1, wherein the second connection portion is connected to the shell body of a second one of the connectors when the connectors are not fitted to each other.

* * * * *